US010366814B2

(12) United States Patent
Ito et al.

(10) Patent No.: US 10,366,814 B2
(45) Date of Patent: Jul. 30, 2019

(54) PERMANENT MAGNET

(71) Applicant: TDK CORPORATION, Tokyo (JP)

(72) Inventors: Masashi Ito, Tokyo (JP); Tomoko Kitamura, Tokyo (JP); Masaki Tomita, Tokyo (JP)

(73) Assignee: TDK CORPORATION, Tokyo (JP)

( * ) Notice: Subject to any disclaimer, the term of this patent is extended or adjusted under 35 U.S.C. 154(b) by 69 days.

(21) Appl. No.: 15/074,491

(22) Filed: Mar. 18, 2016

(65) Prior Publication Data

US 2016/0276075 A1 Sep. 22, 2016

(30) Foreign Application Priority Data

Mar. 20, 2015 (JP) ..... 2015-057535

(51) Int. Cl.
*H01F 1/057* (2006.01)
*H01F 1/058* (2006.01)

(52) U.S. Cl.
CPC ..... *H01F 1/058* (2013.01)

(58) Field of Classification Search
None
See application file for complete search history.

(56) References Cited

FOREIGN PATENT DOCUMENTS

| | | | | |
|---|---|---|---|---|
| JP | 2001068315 A | * | 3/2001 | ..... H01F 1/058 |
| JP | 2008-133496 A | | 6/2008 | |
| JP | 2008133496 A | * | 6/2008 | |
| JP | 2009-231391 A | | 10/2009 | |

OTHER PUBLICATIONS

Machine translation of JP2001068315A, Mar. 2001.*
Saito et al. (IOP Conf. Series: Materials Science and Engineering, 2009, vol. 1, No. 012032).*
Sultana et al. Journal of Applied Physics, 2008, vol. 103, 07E125.*
Geng et al. (Journal of Alloys and Compounds, 1999, vol. 291, p. 276-281).*
Machine translation of JP2008-133496A, Jun. 2008.*
Saito Tetsuji, et al., "Magnetic properties of (Sm,Y)5Fe17 melt-spun ribbons," Journal of Applied Physics, vol. 109, 07A724 (2011).

* cited by examiner

*Primary Examiner* — Xiaowei Su
(74) *Attorney, Agent, or Firm* — Oliff PLC

(57) ABSTRACT

The present invention provides a permanent magnet with a composition ratio of $R_XT_{(100-X-Y)}C_Y$ having a main phase with $Nd_5Fe_{17}$ type crystal structure, wherein: R is one or more rare earth elements including Sm as a necessary element, and the rare earth elements are Sm, Y, La, Pr, Ce, Nd, Eu, Gd, Tb, Dy, Ho, Er, Tm, Yb and Lu; and T is one or more transition metal elements including Fe or a combination of Fe and Co as necessary elements; and $15<X<40$, $5<Y<15$, $1.5<(100-X-Y)/X<4$.

7 Claims, 1 Drawing Sheet

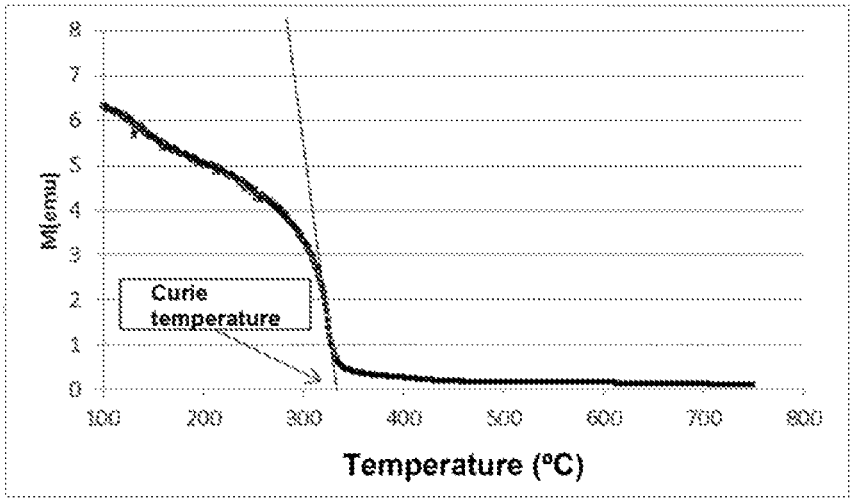
8
7
6
5
4
3
2
1
0
M[emu]
Curie temperature
100
200
300
400
500
600
700
800
Temperature (°C)

PERMANENT MAGNET

The present invention relates to a permanent magnet having a compound with $Nd_5Fe_{17}$ type structure (which belongs to the space group of $P6_3/mcm$) as a main phase.

BACKGROUND

As a representative permanent magnet with high performance, the R-T-B based permanent magnet has an increasing production each year for its high magnetic properties, and it is used in; various applications such as various motors, various actuators, MRI apparatus and the like. In the R-T-B based permanent magnet, R is at least one selected from rare earth elements, T is Fe or a combination of Fe and Co, and B is boron.

In recent years, with the popularity of the hybrid electric vehicle (HEV), the demand for the R-T-B based permanent magnet used in the motor/generator of HEV is increased. In the above applications, the magnet is exposed in a relative high temperature and has a problem of demagnetization at high temperature caused by heat, thus, a permanent magnet having a high maximum energy product and a high heat resistance is preferred. In order to maintain the high magnetic properties even under a high temperature, at method of sufficiently increasing the coercivity of the R-T-B based sintered magnet under room temperature is known to be effective.

For example, in the Patent Document 1, the coercivity under room temperature is increased by controlling the grains and the grain boundaries, and a maximum high coercivity of about 30 kOe is obtained. However, a permanent magnet with even higher properties is required.

In addition, permanent magnets with a high coercivity other than the R-T-B based permanent magnet are proposed. In Patent Document 2, in a permanent magnet with $Sm_5Fe_{17}$ intermetallic compound as the main phase, a quite high coercivity of 37 kOe under room temperature is obtained. Further, 1 at % of C or B or the like is added and enters into the grain boundary part, causing the micronization of the main phase grains and thus a permanent magnet with good magnetic properties is obtained.

However, as described in Non-Patent Document 1, the $Sm_5Fe_{17}$ intermetallic compound has Curie temperature of about 270° C. which is lower than that of the representative R-T-B based permanent magnet of $Nd_2Fe_{14}B$. Thus, it is easy to demagnetize at high temperature and does not suit for an application which demands for high properties under high temperature. Even in the samples added with 1 at % of C or B or the like, the improvement for the demagnetization at high temperature still cannot be said to be sufficient. The improvement for the demagnetization at high temperature of $Sm_5Fe_{17}$ intermetallic compound is useful because the high coercivity under room temperature can be effective utilized till high temperature.

PATENT DOCUMENTS

Patent Document 1: JP2009-231391
Patent Document 2: JP2008-133496

NON-PATENT DOCUMENTS

Non-Patent Document: Journal of Applied Physics 109 07A724(2011)

SUMMARY

The present invention aims to provide a permanent magnet having a high coercivity under high temperature.

In the present invention, the problem mentioned above is solved by a permanent magnet characterized in that, the composition ratio is $R_XT_{(100-X-Y)}C_Y$ (R is one or more rare earth elements including Sm as a necessary element, and the rare earth elements are Sm, Y, La, Pr, Ce, Nd, Eu, Gd, Tb, Dy, Ho, Er, Tm, Yb and Lu; and T is one or more transition metal elements including Fe or a combination of Fe and Co as necessary elements; and $15<X<40$, $5<Y<15$, $1.5<(100-X-Y)/X<4$), and the main phase has $Nd_5Fe_{17}$ type crystal structure.

In the present invention, it is found that, compared to the conventional permanent magnet with the main phase having $Nd_5Fe_{17}$ type crystal structure (the space group of $P6_3/mcm$), Curie temperature is elevated and the coercivity under a high temperature is increased through the solid solution of C in the permanent magnet with the main phase having $Nd_5Fe_{17}$ type crystal structure. The phase having $Nd_5Fe_{17}$ type crystal structure (the space group of $P6_3/mcm$) is described as $R_5T_{17}$ crystal phase as follows. Similarly, for example, the phase having $RT_2$ type crystal structure is described as $RT_2$ crystal phase.

In the present invention, the inventors considered that when more than 5 at % of C is added, C intrudes into the interstices of $R_5T_{17}$ crystal phase rather than the grain boundary part. The distance between the atoms of T-T is enlarged, and the exchange interaction between the atoms of T-T becomes stronger. Thus, the magnetic moment of the total permanent magnet is stabilized and Curie temperature is elevated.

The composition ratio of the permanent magnet of the present invention is $R_XT_{(100-X-Y)}C_Y$ ($15<X<40$, $5<Y<15$, $1.5<(100-X-Y)/X<4$). When a value of X is 15 or less, $R_5T_{17}$ crystal phase cannot be Obtained and the coercivity is decreased remarkably. When a value of X is 40 or more, lots of $RT_2$ crystal phase or the like is formed and thus the coercivity is decreased remarkably. When a value of is 5 or less, the amount of the solid-soluted C in $R_5T_{17}$ crystal phase is small, resulting insufficient effectiveness on the elevating of Curie temperature. Thus, sufficiently high coercivity under a high temperature cannot be obtained. When a value of Y is 15 or more, lots of R—C compounds such as amorphous state, $R_3C$, $R_2C_3$, $RC_2$ and the like are formed. Thus, the coercivity is decreased. In addition, the composition ratio of R and T is set as $1.5<(100-X-Y)/X<4$. When a value of $(100-X-Y)/X$ is 1.5 or less, lots of $RT_2$ crystal phase or the like is formed and thus the coercivity is decreased remarkably. When a value of $(100-X-Y)/X$ is 4 or more, components with low coercivity such as α-Fe crystal phase are formed and thus the coercivity is decreased remarkably.

According to the present invention, a permanent magnet can be provided wherein the heat resistance demanded in the permanent magnet for HEV which tends to increase in future can be satisfied. The permanent magnet has high Curie temperature and has a high coercivity even under a high temperature.

BRIEF DESCRIPTION OF THE DRAWINGS

FIG. 1 is a magnetization-temperature curve of the permanent of Example 1 and illustrates the tangent for calculating Curie temperature.

DETAILED DESCRIPTION OF EMBODIMENTS

Hereinafter, the present invention will be described in detail based on embodiments. The present invention is not limited to the contents described in the following embodiments. In addition, the constituent elements described, below include those easily thought of by those skilled in the art and those substantially the same. Further, the constituent elements described below can be properly used in combination.

The permanent magnet of the present embodiment is preferred to be a single phase of $R_5T_{17}$ crystal phase. However, crystal phases of $RT_2$, $RT_3$, $RT_7$, $RT_5$, $RT_7$, $R_2T_{17}$; $RT_{12}$ can be contained as long as $R_5T_{17}$ crystal phase is the main phase. Herein, the main phase is the crystal phase with the largest volume ratio in the permanent magnet.

In the total permanent magnet, the volume ratio of $R_5T_{17}$ crystal phase as the main phase is 50% or more, and preferably 75% or more. The larger the ratio of $R_5T_{17}$ crystal phase is, the higher the coercivity under a high temperature is.

In the permanent magnet with the composition ratio of the $R_XT_{(100-X-Y)}C_Y$ of the present embodiment, R is one or more rare earth elements including Sm as the necessary element, wherein rare earth elements are Sm, Y, La, PT, Ce, Nd, Eu, Gd, Tb, Dy, Ho, Er, Tm, Yb and Lu. The ratio of Sm in the total rare earth elements is preferred to be large and the atom ratio of Sm to the amount of the total rare earth elements is preferred to be 50 at % or more.

With regard to the composition ratio of R, X in $R_x T_{(100-X-Y)}C_Y$ is set as $15<X<40$. When the value of X is 15 or less. $R_5T_{17}$ crystal phase cannot be obtained and the coercivity decreases remarkably. On the other hand, when the value of X is 40 or more, lots of $RT_2$ crystal phase or the like with low coercivity is formed and thus the coercivity is decreased remarkably.

In the permanent magnet with the composition ratio of $R_XT_{(100-X-Y)}C_Y$ of the present embodiment, T is one or more transition metal elements with Fe or a combination of Fe and Co as the necessary elements. Co is preferred to be 20 at % or less in the total transition metal elements. The saturation magnetization can be increased by selecting a proper amount of Co. In addition, the corrosion resistance of the permanent magnet can be enhanced by increasing the amount of Co.

With regard to the composition ratio of R and T, it is set as $1.5<(100-X-Y)/X<4$. When $(100-X-Y)/X$ is 1.5 or less, lots of $RT_2$ crystal phase is formed and the coercivity is decreased remarkably. When $(100-X-Y)/X$ is 4 or more, components with low coercivity such as α-Fe crystal phase are formed and the coercivity is decreased remarkably.

With regard to the composition ratio of C, Y in $R_X T_{(100-X-Y)}C_Y$ is set as $5<X<15$. When the value of Y is 5 or less, the effectiveness on the elevating of Curie temperature is not sufficient. Thus, a high coercivity under a high temperature cannot be obtained. When the value of is 15 or more lots of R—C compounds such as amorphous state, $R_3C$, $R_2C_3$, $RC_2$ and the like are formed. The ratio of obtained $R_5T_{17}$ crystal phase is decreased and the coercivity is decreased.

The permanent magnet with the composition ratio of $R_XT_{(100-X-Y)}C_Y$ of the present embodiment can contain other elements. For example, elements selected from the group consisting of Zr, Ti, Bi, Sn, Ga, Nb, Ta, Si, V, Ag, Ge, Cu, Zn and the like can be contained properly. Additionally, R can contain impurities from the starting materials.

The permanent magnet with the composition ratio of $R_XT_{(100-X-Y)}C_Y$ of the present embodiment can contain other intrusion elements besides C, and the intrusion elements can be one or more elements selected from the group consisted of N, H, Be and P.

Hereinafter, preferred examples of the manufacturing method of the present invention will be described. The methods for manufacturing the permanent magnet include sintering method, ultra-rapid solidification method, vapor deposition method, HDDR method and the like. An example of the ultra-rapid solidification method will be described. As a specified ultra-rapid solidification method, single-roller method, double-roller method, centrifugal quenching method, gas atomizing method and etc, can be listed and the single-roller method is preferred. In the single-roller method, molten alloy is ejected from nozzle and collides with the circumferential surface of the quenching roller. Thus, the molten alloy is cooled rapidly and quenched alloy in a ribbon shape or sheet shape is obtained. The single-roller method has a higher productivity and a better reproducibility of the quenching condition compared to other ultra-rapid solidification methods.

As the raw material metal, R-T alloy with desired composition ratio is prepared. The raw material alloy can be manufactured from raw materials of R and T in inert gas (preferably in Ar atmosphere) by arc melting or other weft-known melting methods. In the case that other elements such as Zr, Ti, Bi, Sn, Ga, Nb, Ta, Si, V, Ag, Ge, Cu, Zn and the like are expected to be contained properly, melting method can be involved similarly.

An amorphous alloy is prepared from the R-T alloy prepared by the method mentioned above by an ultra-rapid solidification method. In the ultra-rapid solidification method, the alloy ingot prepared by the process mentioned above is made into small pieces by stamp mill or the like to prepare the raw material. A melt-spinning method is applied in which the small pieces are high-frequency induction melted in Ar atmosphere and the molten alloy is ejected onto a copper roller rolling in a high speed and rapidly solidified. The molten alloy which is quenched by the roller becomes a quenched alloy which is rapidly solidified, in a ribbon shape.

The composition ratio of the quenched alloy can be varied according to the peripheral velocity of the cooling roller. The quenched alloy can be any structures selected from amorphous single phase, mixed phase of amorphous phase and crystal phase, and crystal phase. The amorphous phase will turn to be finely crystallized by a heat treatment performed later. As a standard, if the peripheral velocity of the cooling roller is large, the ratio of the amorphous phase become high.

If the peripheral velocity of the cooling roller is fast, the obtained quenched alloy will become thin and thus a more homogeneous quenched alloy can be obtained. After a structure of amorphous single phase is obtained. $R_5T_{17}$ crystal phase can be obtained by proper heat treatment. In this way, amorphous alloy or a mixture of amorphous alloy and $R_5T_{17}$ crystal phase which is the preferred structure of the present invention is obtained. In order to get the structure, the peripheral velocity of the cooling roller is usually set as 10 m/s is to 100 m/s and preferably set as 1.5 m/s to 75 m/s and further preferably set as 25 m/s to 65 m/s. If the peripheral velocity of the cooling roller is less than 10 m/s, homogeneous quenched alloy cannot be obtained and the desired crystal phase is hard to be obtained. If the peripheral velocity of the cooling roller surpasses 100 m/s, the adhesion between the molten alloy and the cooling roller circumferential surface will become worse and heat transfer cannot be effectively carried out.

The quenched alloy is provided to crystallization treatment and carbonization treatment in the following step. The crystallization treatment is carried out in Ar atmosphere usually for about 0.6 min to 600 min under a temperature of 700° C. to 950° C. The carbonization treatment is carried out in a carbonization atmosphere such as $Ar+CH_4$ or $Ar+C_2H_6$ or the like usually for about 0.6 min to 600 min under a temperature of 450° C. to 600° C. Herein, the R-T alloy will react with C and thus C will solid-solute in the inner part of $R_5T_{17}$ crystal phase by adjusting the concentration of the hydrocarbon gas as 5 weight % to 25 weight %.

The processes mentioned above are the basic processes to obtain the permanent magnet of the present invention. The alloy obtained by the melt-spinning method can be pulverized in any step either before the heat treatment or after the heat treatment. The pulverized alloy can be mixed with the binder and molded into a bond permanent magnet. Additionally, the pulverized alloy can be made into an anisotropic permanent magnet by well-known technologies such as but working method and the like. In addition, it can also be made into an anisotropic permanent magnet through the processes of pulverization, molding in magnetic field and sintering.

Next, a preferred example of the manufacturing method by thin-film method is described.

Manufacturing method for alloy thin film includes vacuum deposition method, sputtering method and molecular beam epitaxy method and so on. Among these methods, an example of the manufacturing method by sputtering method is described.

First, a target material is prepared as the starting material. The target material is made into an R-T alloy target material with a desired composition ratio. Herein, the composition ratio of the target material and the composition ratio of the film prepared by the sputtering method may deviate from each other for the reason that the sputtering rate of each element is different. Thus, they need to be adjusted. The sputtering can also be performed by using an apparatus with 2 or more sputtering devices and using target materials of each single element of R and T with a desired ratio. In the case that other elements such as Zr, Ti, Bi, Sn, Ga, Nb, Ta, Si, V, Ag, Ge, Zn, Cu and the like are expected to be contained properly, sputtering can also be performed under a desired ratio similarly.

The target material will be oxidized from the surface during storage. Especially, when target materials of rare earth elements of R and the like are used, the oxidation rate will be fast. Thus, it is required to perform a sufficient sputtering to expose pure surfaces of the target materials before the using of the target materials.

The substrate used in the sputtering for deposition can be chosen as those selected from various metals, glass, silicon, ceramics and the like. However, in order to obtain a desired crystal structure, a treatment under a high temperature is needed. Thus, materials with a high melting point are preferred. In addition, when the adhesion of the substrate with the formed film is not sufficient as a strategy, under layer of Cr, Ti, Ta, Mo or the like is usually set to improve the adhesion.

As impurity elements of O and the like is preferred to be minimized to the largest extent, the vacuum tank of the deposition apparatus performing sputtering is preferred to be degassed to $10^{-6}$ Pa or lower and more preferably $10^{-8}$ Pa or lower. In order to maintain a high vacuum state, it is desirable to set a chamber for introducing the substrate which is connected to a deposition chamber. As it is required to perform a sufficient sputtering to expose pure surfaces of the target materials before the using of the target materials, the deposition apparatus is preferred to have a shelter between the substrate and the target material which can be operated in a vacuum state. The method of sputtering is preferred to use the magnetron sputtering method which can perform sputtering under a lower Ar atmosphere for the purpose of decreasing impurity elements to the largest extent. Herein, a target material containing Fe or Co will decrease the leakage flux of the magnetron sputtering to a large extent, which will make the sputtering hard to be performed. Thus, the thickness of the target material should be selected properly. The power supply of the sputtering can be either DC or RF and can be properly selected according to the target materials.

An R-T alloy thin film with a desired composition ratio can be deposited by using the R-T alloy target material and the substrate mentioned above.

During the sputtering, the substrate is preserved under room temperature and applied with crystallization treatment and carbonization treatment after the deposition process. The crystallization treatment is performed under a temperature of 700° C. to 1100° C. for about 1 min to 6000 min in Ar atmosphere. The films after deposition is usually composed of microcrystalline phase of about several tens of nanometers or amorphous phase and the grains will grow by crystallization treatment. The carbonization treatment is performed in a carbonized atmosphere of $Ar+CH_4$, $Ar+C_2H_6$ or the like for about 1 min to 600 min under a temperature of 450° C. to 600° C. C will solid-solute in the inner part of $R_5T_{17}$ crystal by adjusting the concentration of the hydrocarbon gas to 5 weight % to 25 weight %.

In the above, the preferred embodiments of the manufacturing method of the present invention are described. Herein after, the analyzing method of the composition ratio in the permanent magnet of the present invention is described.

X-ray diffractometry (XRD) is used in the analysis of the generated phase of the sample. Inductively coupled plasma mass spectrometry (ICP) and oxygen airflow combustion-infrared absorption method are used in the analysis of the composition ratio of the sample.

Additionally, in the measurement of the magnetic properties of the samples, vibrating sample magnetometer (VSM) is used.

EXAMPLES

Hereinafter, examples and comparative examples will be used to illustrate the present invention in more details. However, the present invention will not be limited to the following examples.

The permanent magnet of Example 1 was described as follows. Sm and Fe were mixed to have the composition ratio as shown in table 1. Then they were melted in Ar atmosphere to prepare an ingot by arc melting. After that, the ingot was made into small pieces using a stamp mill. The small pieces were high-frequency induction incited in Ar atmosphere and quenched under a peripheral velocity of 40 m/s by a single-roller method to obtain a quenched alloy. The obtained quenched alloy was heated with a heating rate of 700° C./min and applied with a crystallization treatment under 900° C. for 1 min and then quenched. Then it was applied with a carbonization treatment under 600° C. for 30 min and then quenched. The step of crystallization treatment was performed in Ar atmosphere and the step of carbonization treatment was performed in $Ar+CH_4$ atmosphere. The concentration of the $CH_4$ gas was 10 weight %.

After the generated phase of the permanent magnet as the sample was analyzed by XRD, the amount of R and the amount of T were analyzed b ICP respectively and the amount of C in the sample was analyzed by high-frequency induction heating furnace combustion-infrared absorption method. Then the analyzed results were supplemented to decide the composition ratio of the sample.

The measuring methods of the magnetic properties of each sample were illustrated. Curie temperature was measured using a vibrating sample magnetometer (VSM). A sample magnetized under 90 kOe was heated in Ar atmosphere with a heating rate of 1° C./min to a temperature of 25° C. to 750° C. while a magnetic field of 2 kOe was applied. FIG. 1 shows a magnetization-temperature curve of the permanent magnet of Example 1. In the magnetization-temperature curve, a straight line was drawn in the position where the slope of the tangential line became the largest, and the temperature of the intersection of the line with the temperature axis was determined as Curie temperature. Curie temperature in the range of 240° C. to 340° C. was determined as Curie temperature of $R_5T_{17}$ crystal phase. Additionally, the coercivity under 100° C. was measured using VSM. A sample magnetized under 90 kOe was heated in Ar atmosphere to a temperature of 100° C. and the value of the coercivity was obtained from the magnetization curve of the maximum magnetic field ±27 kOe.

The analyzed composition ratios, Curie temperatures of $R_5T_{17}$ crystal phase and the values of the coercivity under 100° C. of Examples 1 to 11 and Comparative Examples 1 to 7 were shown in table 1.

TABLE 1

| | Composition ratio (at %) | | | | | | Curie temperature ($R_5T_{17}$ crystal phase) | Coercivity at 100° C. |
|---|---|---|---|---|---|---|---|---|
| | Sm | Fe | C | Co | Ce | (100 − X − Y)/X | (° C.) | (kOe) |
| Example 1 | 26 | 67 | 7 | — | — | 2.58 | 326 | 26.1 |
| Example 2 | 36.2 | 57.1 | 6.7 | — | — | 1.58 | 311 | 16.4 |
| Example 3 | 18.9 | 73.9 | 7.2 | — | — | 3.91 | 315 | 10.4 |
| Example 4 | 25.7 | 69.2 | 5.1 | — | — | 2.69 | 305 | 16 |
| Example 5 | 26.1 | 67.8 | 6.1 | — | — | 2.6 | 319 | 21.4 |
| Example 6 | 23.2 | 67.7 | 9.1 | — | — | 2.92 | 322 | 25.2 |
| Example 7 | 23.4 | 61.9 | 14.7 | — | — | 2.65 | 324 | 12.2 |
| Example 8 | 16.8 | 67.2 | 6.8 | — | 9.2 | 2.58 | 301 | 11.9 |
| Example 9 | 9.1 | 66.5 | 7.2 | — | 17.2 | 2.53 | 295 | 10.6 |
| Example 10 | 25.5 | 56.9 | 7.1 | 10.5 | — | 2.64 | 322 | 10.8 |
| Example 11 | 26.1 | 47.1 | 6.9 | 19.9 | — | 2.57 | 330 | 10.1 |
| Comparative example 1 | 40.2 | 50.1 | 9.7 | — | — | 1.25 | 298 | 1.4 |
| Comparative example 2 | 17.2 | 75.9 | 6.9 | — | — | 4.41 | 307 | 6.2 |
| Comparative example 3 | 13.8 | 78.9 | 7.3 | — | — | 5.72 | — | 0 |
| Comparative example 4 | 28.1 | 71.9 | — | — | — | 2.56 | 277 | 7.9 |
| Comparative example 5 | 26.3 | 69.5 | 4.2 | — | — | 2.64 | 282 | 9.8 |
| Comparative example 6 | 21.7 | 58.5 | 19.8 | — | — | 2.7 | 304 | 1.5 |
| Comparative example 7 | 20.2 | 71.6 | — | — | 8.2 | 2.52 | 268 | 2.9 |

The permanent magnets of Examples 2 and 3 were described as follows. Sm and Fe were mixed to have the composition ratios as shown in table 1. Then they were prepared into ingots in the same way as Example 1 to prepare quenched alloys. The obtained quenched alloys were applied with a crystallization treatment and a carbonization treatment in the same way as Example 1. That is, when Examples 2 and 3 were compared with Example 1, the composition ratios of Sm and Fe were different.

The permanent magnets of Examples 4 to 7 were described as follows. Sm and Fe were mixed to have the composition ratios as shown in table 1. Then they were prepared into ingots in the same way as Example 1 to prepare quenched alloys. The obtained quenched alloys were applied with a crystallization treatment in the same way as Example 1. A step of carbonization treatment was performed in an atmosphere of Ar+$CH_4$ for 30 min under 600° C. The concentrations of $CH_4$ gas was 5 weight % in Example 4, and the concentrations of $CH_4$ gas was 7 weight % in Example 5, and the concentrations of $CH_4$ gas was 15 weight % in Example 6, and the concentrations of $CH_4$ gas was 25 weight % in Example 7. That is, when Examples 4 to 7 were compared with Example 1, the concentrations of $CH_4$ gas in the step of carbonization treatment were different and the composition ratios of C were different accordingly.

The permanent magnets of Examples 8 and 9 were described as follows. Sm, Ce and Fe were mixed to have the composition ratios as shown in table 1. Then they were prepared into ingots in the same way as Example 1 to prepare quenched alloys. The obtained quenched alloys were applied with a crystallization treatment and a carbonization treatment in the same way as Example 1. That is, when Examples 8 and 9 were compared with Example 1, part of Sm was replaced with Ce.

The permanent magnets of Examples 10 and 11 were described as follows. Sm, Fe and Co were mixed to have the composition ratios as shown in table 1. Then they were prepared into ingots in the same way as Example 1 to prepare quenched alloys. The obtained quenched alloys were applied with a crystallization treatment and a carbonization treatment in the same way as Example 1. That is, when Examples 10 and 11 were compared with Example 1, part of Fe was replaced with Co.

The permanent magnets of Comparative examples 1 to 3 were described as follows. Sm and Fe were mixed to have the composition ratios as shown in table 1. Then they were prepared into ingots in the same way as Example 1 to prepare quenched alloys. The obtained quenched alloys were applied with a crystallization treatment and a carbonization treatment in the same way as Example 1. That is, when Comparative examples 1 to 3 were compared with Example 1, the composition ratios of Sm and Fe were different.

The permanent magnets of Comparative examples 4 to 6 were described as follows. Sm and Fe were mixed to have the composition ratios as shown in table 1. Then they were prepared into ingots in the same way as Example 1 to prepare quenched alloys. The obtained quenched alloys were applied with a crystallization treatment in the same way as Example 1. A step of carbonization treatment was performed in an atmosphere of Ar+$CH_4$ for 30 min under 600° C. The concentration of $CH_4$ gas was 0 weight % in Comparative example 4, and the concentration of $CH_4$ gas was 3 weight % in Comparative example 5, and the concentration of $CH_4$ gas was 40 weight % in Comparative example 6. That is, when Comparative examples 4 to 6 were compared with Example 1, the concentrations of $CH_4$ gas in the step of carbonization treatment were different and the composition ratios of C were different accordingly.

The permanent magnet of Comparative example 7 was described as follows. Sm, Ce and Fe were mixed to have the composition ratios as shown in table 1. Then they were prepared into an ingot in the same way as Example 1 to prepare quenched alloys. The obtained quenched alloys were applied with a crystallization treatment and a carbonization treatment in Ar atmosphere in the same way as Comparative example 4. That is, when Comparative example 7 was compared with Example 8, the concentration of $CH_4$ gas in the step of carbonization treatment was 0 weight % and the composition ratios of C was different accordingly.

Examples 1 to 3 and Comparative Examples 1 to 3

The samples were discussed where the amount of R and the composition ratios of R. and T were changed. In Examples 1 to 3, $R_5T_{17}$ crystal phase as the main phase was detected by XRD. Additionally, in the magnetization-temperature curve, Curie temperature became higher than that of the conventional $Sm_5Fe_{17}$ crystal phase (277° C. (Comparative example 4)). It was considered to because that C intruded into the interstices of $R_5T_{17}$ crystal phase, and the distance between the atoms of T-T was enlarged and the exchange interaction between the atoms of T-T became stronger. As the result, the coercivity under 100° C. showed a value of 10 kOe or more. In Comparative example 1, the amount of Sm was large and lots of $SmFe_2$ crystal phase which had a low coercivity were formed. Thus, the ratio of $R_5T_{17}$ crystal phase became small, and the coercivity under 100° C. was small and showed a value less than 10 kOe. On the other hand, in Comparative example 2, the amount of Sm was small and lots of α-Fe crystal phase was formed and the ratio of $R_5T_{17}$ crystal phase became small, and thus the coercivity under 100° C. became small. Further, in Comparative example 3 where the amount of Sm was small, $R_5T_{17}$ crystal phase could not be detected. Thus, there was even no Curie temperature existing in the temperature range of 240° C. to 340° C.

Example 1, Examples 4 to 7, Comparative Examples 4 to 6

The samples were discussed where the composition ratios of R and T were fixed while the concentrations of $CH_4$ gas in the carbonization treatment were adjusted to change the amounts of C. Comparative example 4 was a sample of $R_5T_{17}$ crystal phase where C was not solid-soluted. Its coercivity was decreased largely by raising the temperature to 100° C. and showed a value less than 10 kOe. In Example 1 and Examples 4 to 7, $R_5T_{17}$ crystal phases which became the main phases were detected by XRD. Curie temperature was higher than that of the conventional $Sm_5Fe_{17}$ crystal phase (277° C. (Comparative example 4)). In this way, proper amount of C was solid-saluted and thus the coercivity under a temperature of 100° C. showed a value of 10 kOe or more. In Comparative example 5, the coercivity under a temperature of 100° C. was less than 10 kOe. It was because that the function of strengthening the exchange interaction produced by the solid-solution of C was not sufficient due to the small amount of C. In Comparative example 6, the amount of C was high, and lots of Sm—C compounds such as amorphous state, $Sm_3C$, $Sm_2C_3$, $SmC_2$ and the like were formed. Thus, the coercivity was decreased.

Example 1, Example 8, Example 9, Comparative Example 7

The samples were discussed where part of R was set as Ce. Even in the case that R was Sm and Ce, $R_5T_{17}$ crystal phase could be detected by XRD. In addition, Curie temperatures were increased by the solid-solution of C and the effects to obtain a high coercivity under a high temperature were the same.

Example 1 Example 10, Example 11

The samples were discussed where the composition ratios of T were changed. Example 10 and Example 11 were samples with part of Fe replaced with Co. Even in the case that T was Fe and Co, $R_5T_{17}$ crystal phase could be detected by XRD and a high coercivity under a high temperature were found.

Herein after, Example 12 prepared by thin film method was described,

An Sm—Fe alloy target material was prepared as the target material by adjusting the deposition by sputtering to have a desired composition ratio. As the substrate material for deposition, a silicon substrate was prepared. The size of the target material was prepared to have a diameter of 76.2 mm and the size of the substrate was prepared to be 10 mm×10 mm, and the conditions for preserving in-plane uniformity of the film sufficiently were set.

As the deposition apparatus, an apparatus which could be degassed to $10^{-8}$ Pa or lower and had several sputtering devices in one chamber was used. In the deposition apparatus, the Sm—Fe alloy target material and the Mo target material used in the under layer were mounted. The sputtering was performed using a magnetron sputtering method in Ar atmosphere of 1 Pa and using an RF power supply. In addition, the power of the RF power supply and the Mite for deposition was adjusted according to the composition of the sample.

The deposition was performed by forming a film of 50 mm of Mo as the under layer firstly. Then, the thickness of the Sm—Fe layer was adjusted to be 50 nm according to each of Examples and comparative Examples and the sputtering was performed.

During the deposition, the silicon substrate was preserved under room temperature. A Mo under layer and a Sm—Fe layer was formed. The deposited sample as heated in Ar atmosphere with a heating rate of 700° C./min. Next it was applied with a crystallization treatment for 1 mm wider a temperature of 900° C. and then quenched. After that, a carbonization treatment Was performed for 30 min under a temperature of 600° C. The step of carbonization treatment was performed in an atmosphere of Ar+$CH_4$. The concentration of the $CH_4$ gas was 10 weight %.

The generated phase of the permanent magnet of the sample was analyzed by XRD in the direction perpendicular to a plane. After that, the amount of R and the amount of T were analyzed by ICP mass spectrometry and the amount of C in the sample was analyzed by high-frequency induction heating furnace combustion-infrared absorption method. Then the analyzed results were supplemented to decide the composition ratio of the sample.

The measuring methods of the magnetic properties of the samples were illustrated. Curie temperature was measured using a vibrating sample magnetometer (VSM). A sample magnetized under 90 kOe in the in-plane direction was heated in Ar atmosphere with a heating rate of 1° C./min while a magnetic field of 2 kOe was applied in the in-plane direction. Additionally, the coercivity under 100° C. was measured using VSM. A sample magnetized under 90 kOe in the in-plane direction of magnetic thin film was heated in Ar atmosphere to a sample temperature of 100° C. and the value of the coercivity was obtained from the magnetization curve of the maximum magnetic field ±27 kOe in the in-plane direction.

The analyzed composition ratios, Curie temperatures of $R_5T_{17}$ crystal phase and the values of the coercivity under 100° C. of Examples 12 to 18 and Comparative Examples 8 to 13 which were prepared by the thin film method were shown in table 2.

TABLE 2

| | Composition ratio (at %) | | | | Curie temperature ($R_5T_{17}$ crystal phase) | Coercivity (kOe) |
|---|---|---|---|---|---|---|
| | Sm | Fe | C | (100 − X − Y)/X | (° C.) | At 100° C. |
| Example 12 | 26.4 | 67.1 | 6.5 | 2.54 | 323 | 21.6 |
| Example 13 | 37.1 | 55.8 | 7.1 | 1.51 | 305 | 13.1 |
| Example 14 | 18.7 | 74.2 | 7.1 | 3.97 | 302 | 10 |
| Example 15 | 25.2 | 69.7 | 5.1 | 2.77 | 298 | 13.2 |
| Example 16 | 25.7 | 68.3 | 6 | 2.66 | 310 | 18.7 |
| Example 17 | 23.4 | 67.1 | 9.5 | 2.87 | 321 | 19.2 |
| Example 18 | 23.4 | 62.3 | 14.3 | 2.66 | 322 | 15.4 |
| Comparative example 8 | 44.2 | 45.3 | 10.5 | 1.02 | 297 | 1 |
| Comparative example 9 | 15.8 | 76.4 | 7.8 | 4.84 | 305 | 0.2 |
| Comparative example 10 | 13.4 | 77.7 | 8.9 | 5.8 | — | 0 |
| Comparative example 11 | 28.1 | 71.9 | — | 2.56 | 272 | 7 |
| Comparative example 12 | 27.4 | 69 | 3.6 | 2.52 | 278 | 9.2 |
| Comparative example 13 | 21.7 | 59.3 | 19 | 2.73 | 301 | 0.8 |

The permanent magnets of Examples 13 and 14 were described as follows. Sm and Fe were adjusted to have the composition ratios as shown in table 2 and then prepared as thin films. The obtained thin films were applied with a crystallization treatment and a carbonization treatment in the same way as Example 12. That is, when Examples 13 and 14 were compared with Example 12, the composition ratios of Sm and Fe were different.

The permanent magnets of Examples 15 to 18 were described as follows. Sm and Fe were adjusted to have the composition ratios as shown in table 2 and then prepared as thin films. The obtained thin films were applied with a crystallization treatment in the same way as Example 12. A step of carbonization treatment was performed in an atmosphere of Ar+$CH_4$ for 30 min under 600° C. The concentration of $CH_4$ gas was 5 weight % in Example 15, and the concentration of $CH_4$ gas was 7 weight % in Example 16, and the concentration of $CH_4$ gas was 15 weight % in Example 17 and the concentration of $CH_4$ gas was 25 weight % in Example 18. That is, when Examples 15 to 18 were compared with Example 12, the concentrations of $CH_4$ gas in the step of carbonization treatment were different and the composition ratios of C were different accordingly.

The permanent magnets of Comparative examples 8 to 10 were described as follows. Sm and Fe were adjusted to have the composition ratios as shown in table 2 and prepared as thin films. The obtained thin films were applied with a crystallization treatment in the same way as Example 12. A step of carbonization treatment was performed in an atmosphere of Ar+$CH_4$ for 30 min under 600° C. The concentration of $CH_4$ as was 10 weight %. That is, when Comparative examples 8 to 10 were compared with Example 12, the composition ratios of Sm and Fe were different.

The permanent magnets of Comparative examples 11 to 13 were described as follows. Sm and Fe were adjusted to have the composition ratios as shown in table 2 and prepared as thin films. The obtained thin films were applied with a crystallization treatment in the same way as Example 12. A step of carbonization treatment was performed in an atmosphere of Ar+$CH_4$ for 30 min under 600° C. The concentration of $CH_4$ gas were 0 weight % in Comparative example 11, and the concentration of $CH_4$ gas was 3 weight % in Comparative example 12, and the concentration of $CH_4$ gas was 40 weight % in Comparative example 13. That is, when Comparative examples 11 to 13 were compared with Example 12, the concentrations of $CH_4$ gas in the step of carbonization treatment were different and the composition ratios of C were different accordingly.

Examples 12 to 14 and Comparative Examples 8 to 10

The samples were discussed where the amount of R and the composition ratios of R and T were changed. In Examples 12 to 14, $R_5T_{17}$ crystal phase as the main phase was detected by XRD. Additionally, from the magnetization-temperature curve, Curie temperature became higher than that of the conventional $Sm_5Fe_{17}$ crystal phase (272° C. (Comparative example 11)). It is considered to because that C intruded into the interstices of $R_5T_{17}$ crystal phase, and the distance between the atoms of T-T was enlarged and the exchange interaction between the atoms of T-T became stronger. As the result, the coercivity under 100° C. showed a value of 10 kOe or more. In the thin film magnet, a magnet in which C was solid-soluted in $R_5T_{17}$ crystal phase could also be prepared by adjusting the amount of R properly. In Comparative example 8, the amount of Sm was large and lots of $SmFe_2$ crystal phase which had a low coercivity was formed. Thus, the ratio of $R_5T_{17}$ crystal phase became small, and the coercivity under 100° C. shows a value less than 10 kOe. On the other hand, in Comparative example 9, the amount of Sm was small and lots of α-Fe crystal phase was formed in the step of crystallization treatment and the ratio of $R_5T_{17}$ crystal phase became small, and thus the coercivity under 100° C. became small. Further, in Comparative example 10 where the amount of Sm is small, $R_5T_{17}$ crystal phase could not be detected. Thus, there was even no Curie temperature existing in the temperature range of 240° C. to 340° C.

Example 12, Examples 15 to 18, Comparative Examples 11 to 13

The samples were discussed where the composition ratios of R and T were fixed while the concentrations of $CH_4$ gas in the carbonization treatment were adjusted to change the amounts of C. Comparative example 11 was a sample of $R_5T_{17}$ crystal phase where C was not solid-soluted. Its coercivity under 100° C. was less than 10 kOe. In Example 12 and Examples 15 to 18, $R_5T_{17}$ crystal phases which became the main phase were detected by XRD. Curie temperature was higher than that of $Sm_5Fe_{17}$ crystal phase (272° C. (Comparative example 11)), The coercivity under 100° C. shows a value of 10 kOe or more by the solid-solution of proper amount of C. In Comparative example 12, the coercivity under 100° C. was small. It was because that the function of strengthening the exchange interaction produced by the solid-solution of C was not sufficient due to the small amount of C. Also in Comparative example 13, the coercivity under 100° C. was small. It was considered to due to that the amount of C was high, and lots of Sm—C compounds such as amorphous state, $Sm_3C$, $Sm_2C_3$, $SmC_2$ and the like were formed, and the ratio of $R_5T_{17}$ crystal phases became small.

What is claimed is:

1. A permanent magnet with a composition ratio of $R_XT_{(100-X-Y)}C_Y$ comprising a main phase with $Nd_5Fe_{17}$ crystal structure, wherein:

R is one or more rare earth elements including Sm, and the rare earth elements are Sm, Y, La, Pr, Ce, Nd, Eu, Gd, Tb, Dy, Ho, Er, Tm, Yb and Lu; and T is one or more transition metal elements including Fe or a combination of Fe and Co; and $23.2 \leq X(\text{at } \%) \leq 37.1$, $6.0 \leq Y(\text{at } \%) \leq 14.7$, $1.51 \leq (100-X-Y)/X \leq 2.92$.

2. The permanent magnet of claim 1, wherein, Co is 0 at % or more to 10.5 at % or less in the total transition metal elements.

3. The permanent magnet of claim 1, wherein an atom ratio of Sm to an amount of a total rare earth elements is 64.6 at % or more; and T is Fe.

4. The permanent magnet of claim 1, wherein R is Sm; T is Fe; and $6.0 \leq Y(\text{at } \%) \leq 14.3$.

5. The permanent magnet of claim 1, wherein $6.0 \leq Y(\text{at } \%) \leq 9.5$.

6. The permanent magnet of claim 1, which has a Curie point to 295-330° C.

7. The permanent magnet of claim 1, which has a coercivity at a temperature of 100° C. of 10.1-26.1 kOe.

* * * * *